US007597576B2

(12) United States Patent
Zhang

(10) Patent No.: US 7,597,576 B2
(45) Date of Patent: Oct. 6, 2009

(54) ELECTRICAL SYSTEM

(75) Inventor: George (Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/900,558

(22) Filed: Sep. 12, 2007

(65) Prior Publication Data

US 2009/0068872 A1 Mar. 12, 2009

(51) Int. Cl.
*H01R 13/62* (2006.01)

(52) U.S. Cl. ..... 439/299; 439/567

(58) Field of Classification Search ..... 439/229, 439/567, 570, 299
See application file for complete search history.

(56) References Cited

U.S. PATENT DOCUMENTS 6,435,905 B1 * 8/2002 Yu et al. ..... 439/567
6,443,768 B1 * 9/2002 Dirkers et al. ..... 439/607
6,942,524 B2 * 9/2005 Wu ..... 439/637
2003/0022533 A1 * 1/2003 Joo ..... 439/67

* cited by examiner

*Primary Examiner*—Tho D Ta
*Assistant Examiner*—Travis Chambers
(74) *Attorney, Agent, or Firm*—Wei Te Chung

(57) ABSTRACT

An electrical system (1000) for electrical connecting with a hard disk drive (2), comprises a metal chassis (4) defining an opening (400) therein and an electrical connector, snugly assembled to the opening (400). The electrical connector includes an insulative housing (1) defining a mating surface, and a mounting surface with a plurality of passageways (110) assembled with corresponding number of contact terminals. The housing (1) further defining longitudinal ends (12). Each of the longitudinal ends (12) provided with an anchoring member (13) having a body (130) securely retained within the end, and a hook (132) extending substantially toward the mating portion, and securely interlocked to edges of the opening of the chassis (4).

12 Claims, 6 Drawing Sheets

ELECTRICAL SYSTEM

BACKGROUND OF THE INVENTION

1. Field of the Invention

The present invention relates to an electrical system being mounted to a hard disk drive for providing electrical connection with a printed circuit board.

2. Description of the Prior Art

Compression header is commonly used on HAS (Head Stacker Assembly) of Hard disk drive. It is always used for electrical connecting the hard disk drive and the printed circuit board. It is soldered on the printed circuit board, and then assembled on the die casting base by two screws.

Conventional header assemblies each comprise a housing with a number of terminals received therein and a number of holes disposed thereon, and a hard disk drive with a recess for receiving the header connector therein, a printed circuit board mounted below the hard disk drive for connecting with the header connector and a number screws passing through the holes of the housing connecting with the header connector on the printed circuit board.

However, in abovementioned electrical connector assembly, the assembling process relies on the screws and mounting the screws on the printed circuit board is too trouble and waste time. In addition, the assembly process is slow and costly.

In view of the above, a new electrical system that overcomes the above-mentioned disadvantages is desired.

SUMMARY OF THE INVENTION

Accordingly, an object of the present invention is to provide an electrical system for simplifying the process of connecting a hard disk drive on a printed circuit board.

To achieve the above-mentioned object, an electrical system for connecting a hard disk drive on a printed circuit board in accordance with a preferred embodiment comprises a metal chassis defining an opening therein and an electrical connector snugly assembled to the opening. The electrical connector includes an insulative housing defining a mating surface, and a mounting surface with a plurality of passageways for receiving corresponding number of contact terminals. And the housing further defines longitudinal ends and each of the longitudinal ends is provided with an anchoring member having a body securely retained within the end, and a pair of hooks extending substantially toward the mating portion, and securely interlocked to edges of the opening of the chassis. Relative to the conventional art, the electrical system provides an anchoring member with a pair of hooks for connecting the housing to the chassis and at the same time though a pair of latching portion for connecting the printed circuit board, which decreases the cost and the assembling time used therein.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
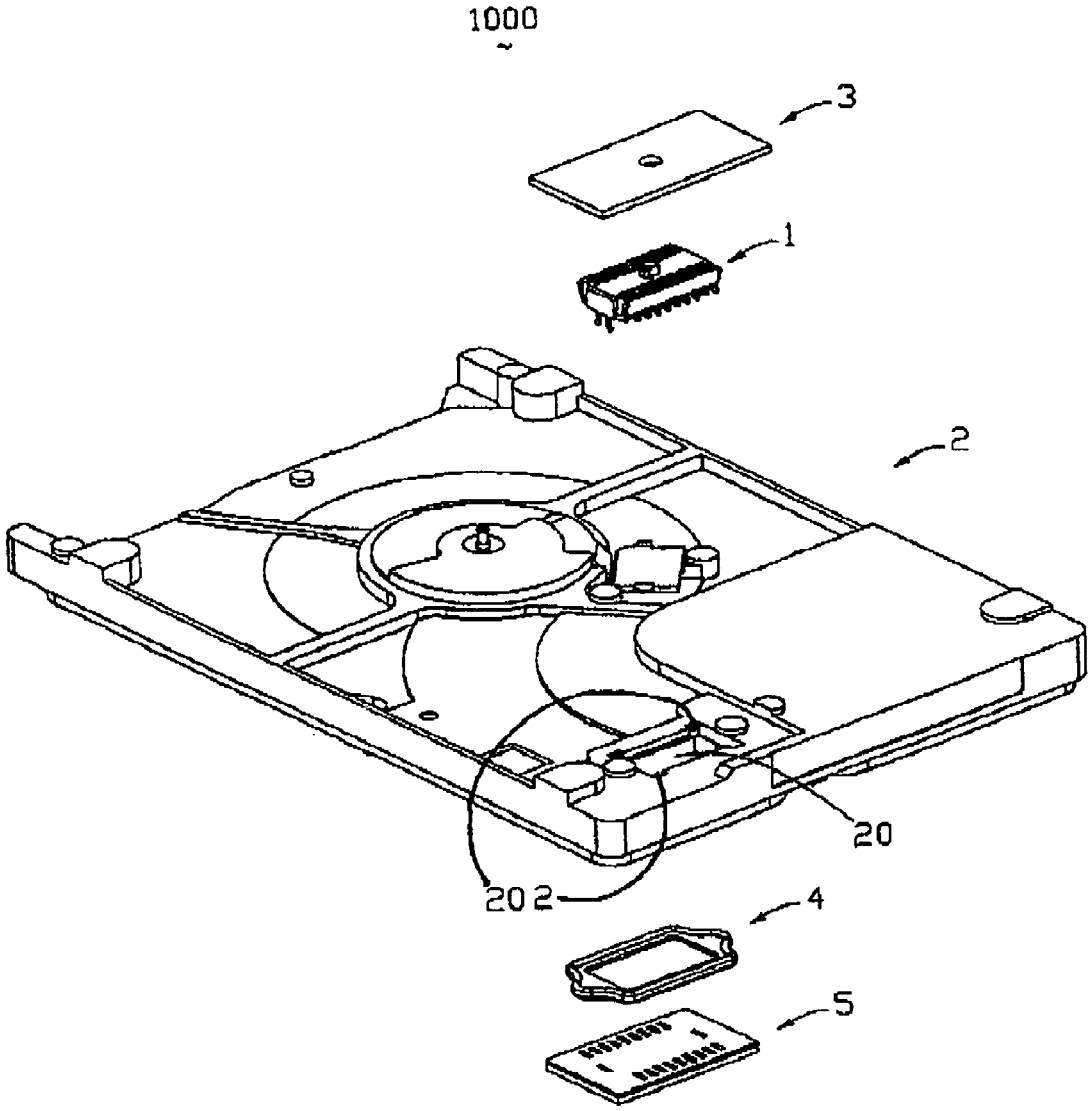
FIG. 1 is an exploded, isometric view of an electrical system in accordance with the preferred embodiment of the present invention.
Figure 2:
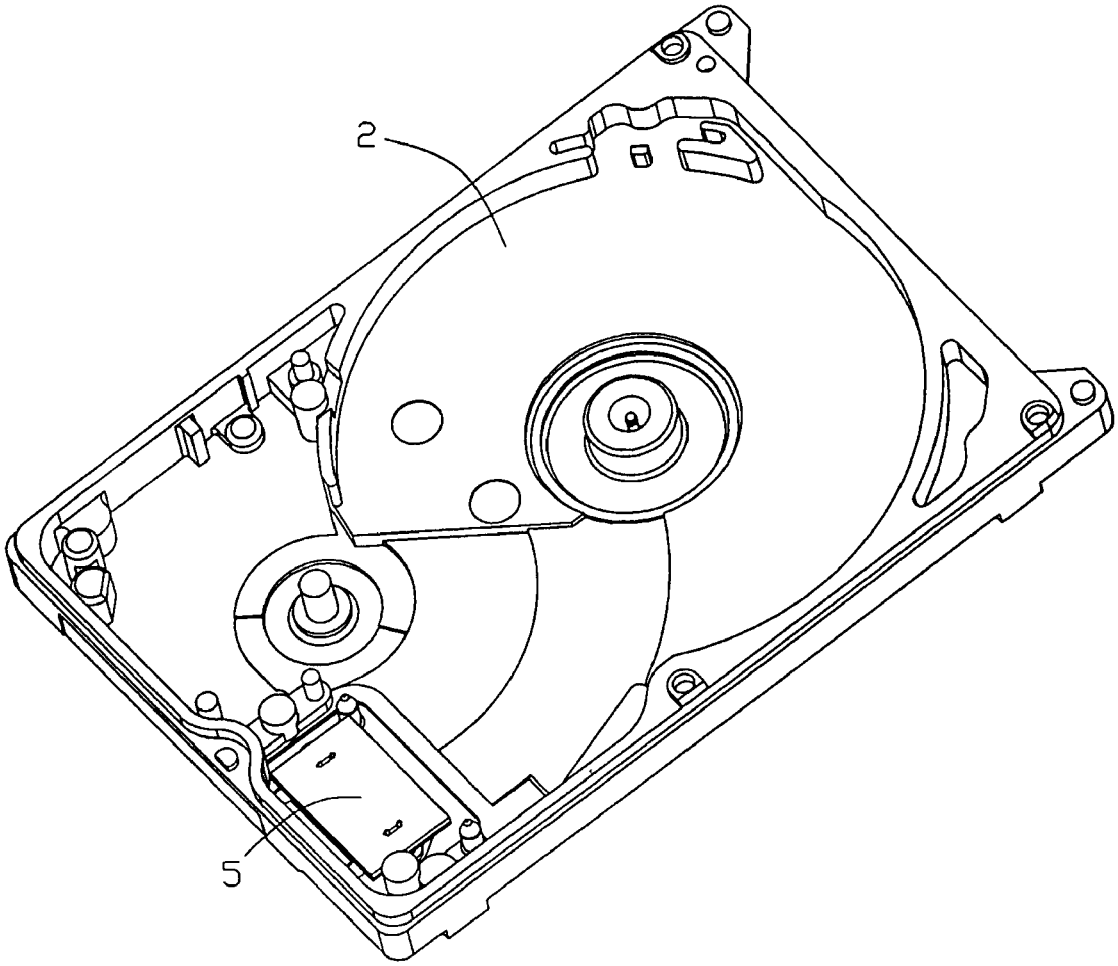
FIG. 2 is an upper assembled view of an electrical system shown in FIG. 1.
Figure 3:
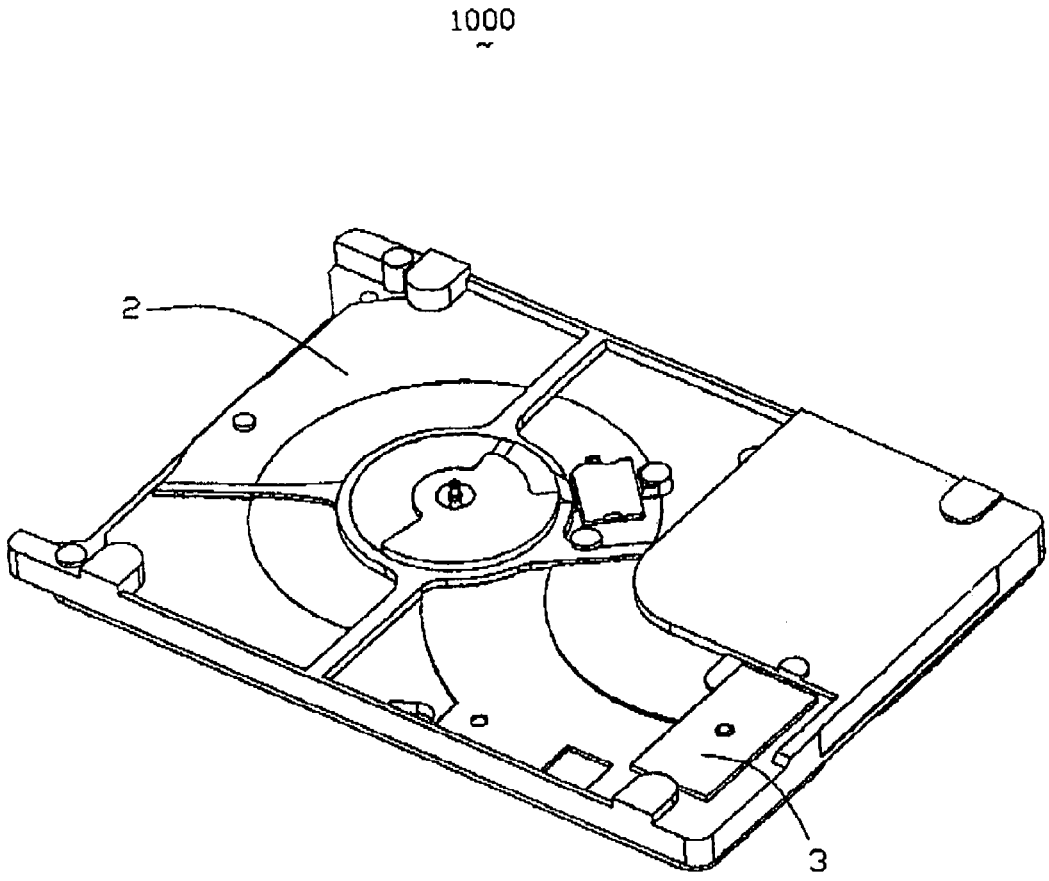
FIG. 3 is a bottom assembled view of an electrical system shown in FIG. 1.
Figure 4:
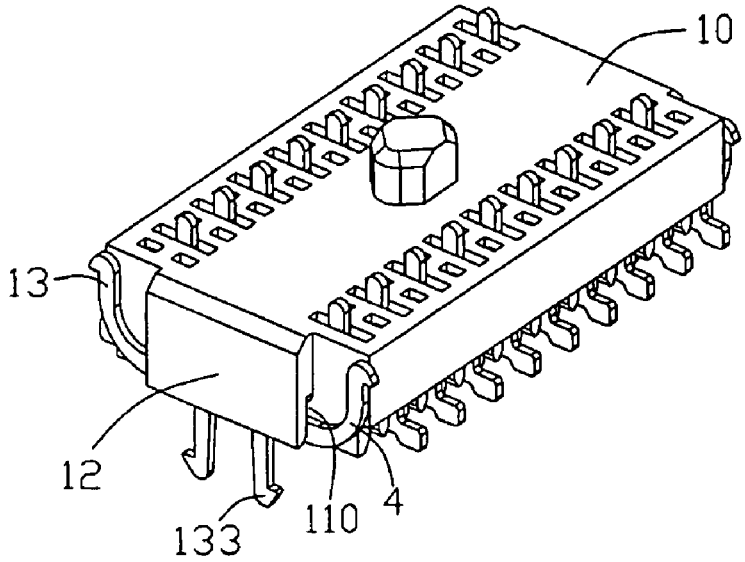
FIG. 4 is an assembled view of the housing assembled the contact terminals and an anchoring member shown in FIG. 1.
Figure 5:
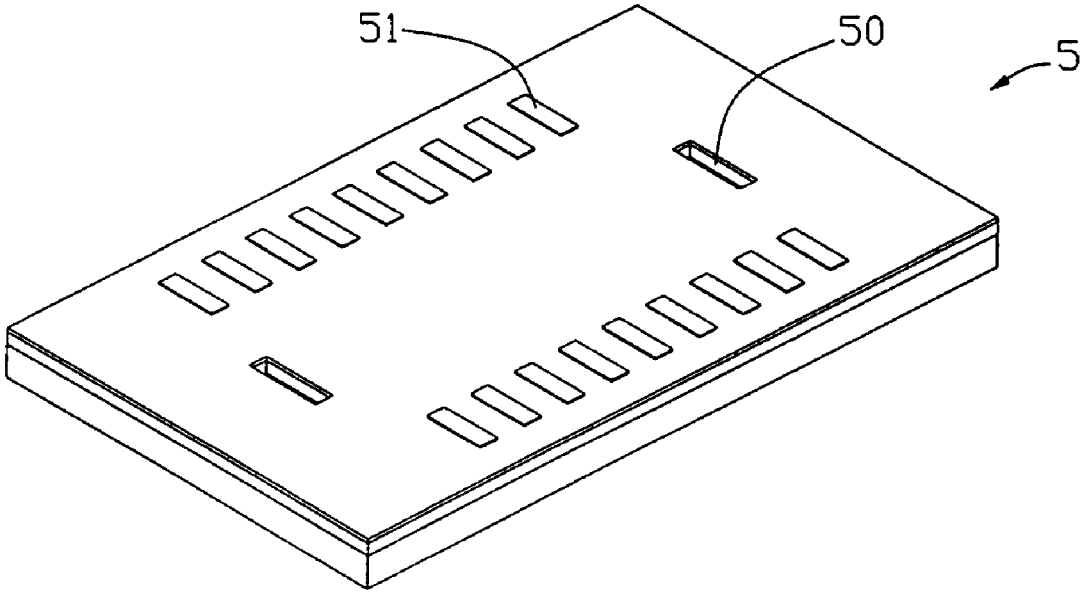
FIG. 5 is a perspective view of the printed circuit board shown in FIG. 1.
Figure 6:
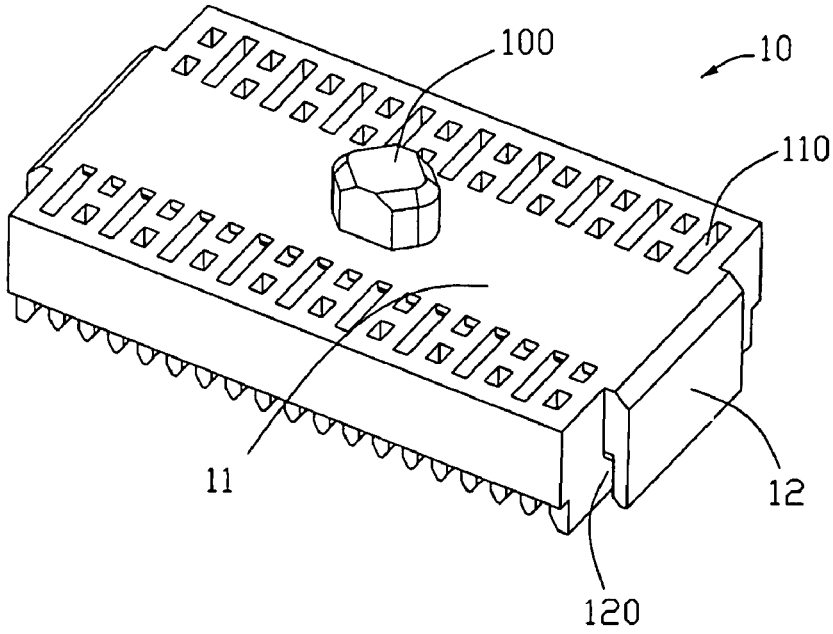
FIG. 6 is an upper perspective view of the housing shown in FIG. 1.
Figure 7:
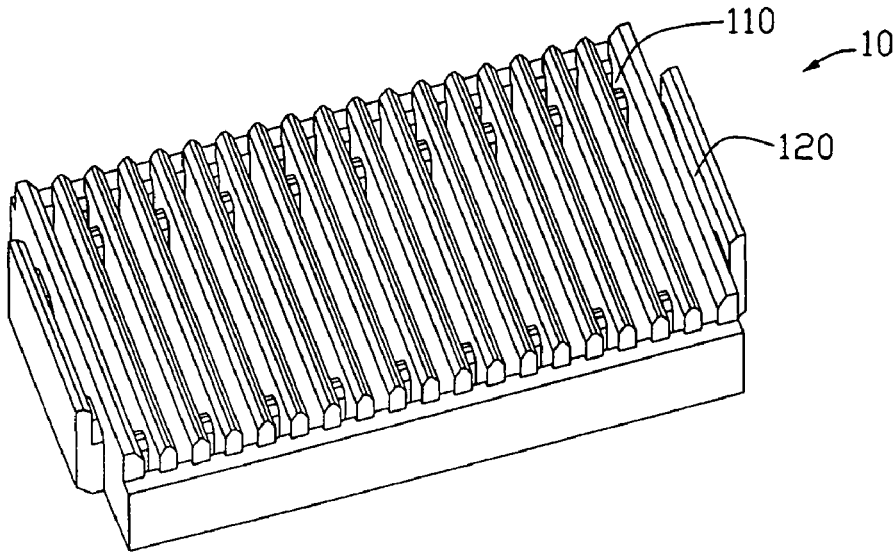
FIG. 7 is a bottom perspective view of the housing shown in FIG. 1.
Figure 8:
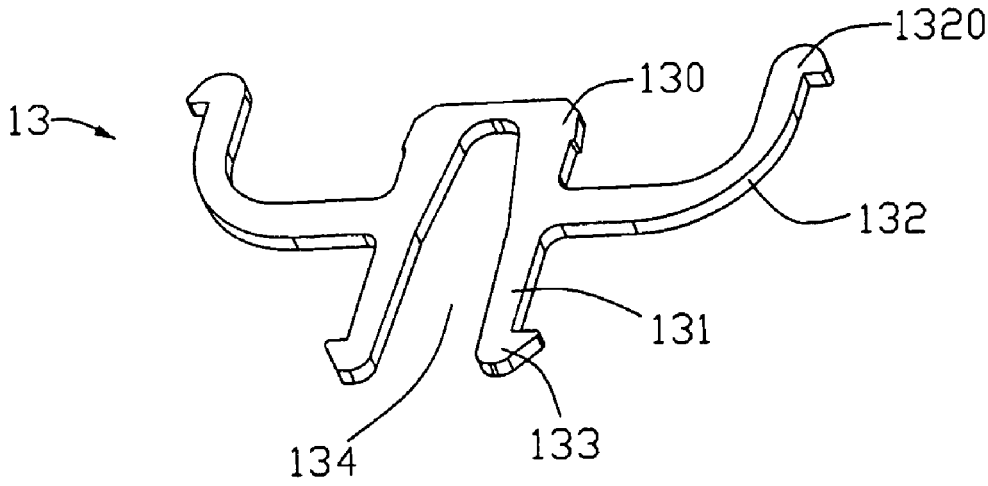
FIG. 8 is a perspective view of the anchoring member shown in FIG. 1.
Figure 9:
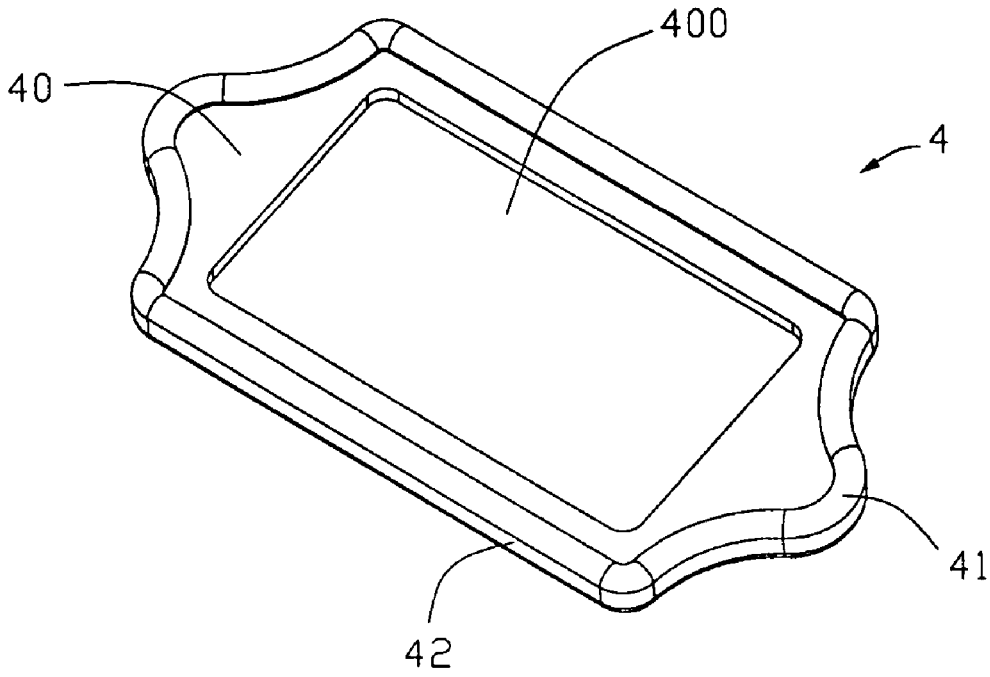
FIG. 9 is a perspective view of the metal chassis shown in FIG. 1.

FIG. 1 is an exploded, isometric view of an electrical system 1000 in accordance with the preferred embodiment of the present invention. The electrical system 1000 for electrical connecting a hard disk drive 2 to a printed circuit board 5 comprises an insulative housing 1 defining a mating surface, and a mounting surface with a plurality of passageways 110 extending therebetween for receiving corresponding number of contact terminals thereof. The insulative housing 1 further defines longitudinal ends 12 and each of the longitudinal ends 12 provided with an anchoring member 13 having a body 130 securely retained within the end, and a hook 132 extending substantially toward the mating surface of the insulative housing 1. The electrical system 1000 further comprises a pressing plate 3 mounted on the housing 1 and a metal chassis 4 mounted below the insulative housing 1.

The insulative housing 1 is configured as rectangular shape and defines a body portion 10 including a mating surface, and a mounting surface with a plurality of passageways 110 extending therebetween for receiving contact terminals thereof. The insulative housing 1 further defines a pair of longitudinal ends 12 extending from two lengthwise direction of the body portion 10 and a projections 100 extending from the mating surface thereon for facilitating the mounting the assembly. There each of the longitudinal ends 12 is provided with an anchoring member 13 for connecting the insulative housing on the printed circuit board 5. In addition, each of the longitudinal ends 12 still defines a receiving recess 120 for receiving corresponding part of the anchoring member 13.

A plurality of contact terminals are arranged within each of the passageways of the insulative housing 1. Each of the contact terminals includes a mating portion extending beyond of the mating surface, and a mounting portion extending beyond the mounting surface and adapted to be mounted onto the printed circuit board 5.

The anchoring member 13 comprises a body 130, a pair of extending portions 131 extending from two opposite ends thereof and an a pair of hooks 132 extending from each extending portion 131 at the center portion thereof. Each extending portion 131 defines a first latch portion 133 at end thereof for engaging with printed circuit board 5, and each hook 132 defines a second latch portion 1320 at end thereof and extending through the opening of the chassis 4 and interlocked into the corresponding locking recess 202. In addition, the two extending portion 131 forms an opening 134 therebetween for increasing the elastic ability.

The hard disk drive 2 is configured as a rectangular shape with a recess 20 adjacent one end for receiving the insulative housing 1 therein.

The printed circuit board 5 is formed in to a rectangular shape with a number of solder pads 51 thereon for contacting with the contact terminals received in the housing 1 and a pair of receiving holes 50 therein for receiving the anchoring members 13 therein.

The metal chassis 4 is mounted below the hard disk drive 2. The metal chassis 4 includes a base 40 defining an opening 400 in the middle thereof and sidewalls 42 around the base 40. And a pair of air portion 41 extending from two opposite ends of the base.

The pressing plate 3 is configured as same shape with the printed circuit board for pressing the housing 1 on the hard disk drive 2.

In assembly, the contact terminals are firstly inserted into the passageways 110 of the insulative housing 1, then the anchoring member 13 are located in the receiving recess 120 of the longitudinal ends 12 of the insulative housing 1. After that, the insulative housing 1 provided with the anchoring member 13 is mounted on the cavity 20 of the hard disk drive 2, then the pressing plate 3 and the metal chassis 4 are separately mounted the upper end of the insulative housing 1 and the bottom end of the insulative housing 1, then the printed circuit board 5 is assembled below the metal chassis 4 though the first latch portion 133 of the anchoring member 13 inserted into the receiving holes 50 of the printed circuit board 5. In the invention, the disposition of the anchoring members 13 decreases the assembling time and providing a solder less assembling manner which is benefit for environment protection. It is noted that the connector is equipped with at least one anchoring member, and the connector is essentially disposed in the through opening with the anchoring member latched into the locking recess so as to prevent the connector and the associated printed circuit board from being dropped away from the hard disk drive casing in a first direction, (i.e. downwardly), under a condition that the printed circuit board defines a horizontal dimension larger than those of the both said connector and said though opening so as to prevent the connector with the associated printed circuit board from being excessive moving with regard to the hard disk drive casing through said through opening in a second direction, (i.e., upwardly), opposite to said first direction.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

an electrical connector including an insulative housing defining opposite mating and mounting faces with a plurality of passageways extending and further through both said mating and mounting faces;

a plurality of contact terminals arranged within each of the passageways, each of said terminals including an mating portion extending beyond of the mating face, and a mounting portion extending beyond the mounting face;

a printed circuit board fastened to a mounting side of the connector and mechanically and electrically connected to the mounting portions of the terminals; and a hard disk drive casing defining a through opening between thereof opposite mating and mounting surfaces with at least a locking recess communicative with the through opening and around the mating surface; wherein the connector is equipped with at least one anchoring member, and the connector is essentially disposed in the through opening with the anchoring member latched into the locking recess so as to prevent the connector and the associated printed circuit board from being dropped away from the hard disk drive casing in a first direction, under a condition that the printed circuit board defines a horizontal dimension larger than those of the both said connector and said through opening so as to prevent the connector with the associated printed circuit board from being excessive moving with regard to the hard disk drive casing through said through opening in a second direction opposite to said first direction.

2. The electrical connector assembly as claimed in claim 1, wherein a gasket is located between the printed circuit board and the mounting surface.

3. The electrical connector assembly as claimed in claim 1, wherein the anchoring member includes a fastening section to attach the printed circuit board to the connector.

4. The electrical connector assembly as claimed in claim 1, wherein the first direction is downward and the second direction is upward.

5. The electrical connector assembly as claimed in claim 1, wherein said connector is assembled into the through opening of the hard disk drive in the second direction.

6. The electrical connector assembly as claimed in claim 1, wherein another printed circuit board is mounted upon the upper face and electrically connected to the mating portions of the terminals.

7. The electrical connector assembly as claimed in claim 6, wherein the mating portion of the terminal is electrically and mechanically connected to the printed circuit board in a manner of solderless compression type.

8. An electrical connector assembly comprising:

an electrical connector including an insulative housing defining opposite mating and mounting faces with a plurality of passageways extending and further trough both said mating and mounting faces;

a plurality of contact terminals arranged within each of the passageways, each of said terminals including an mating portion extending beyond of the mating face, and a mounting portion extending beyond the mounting face;

a first printed circuit board fastened to a mounting side of the electrical connector and mechanically and electrically connected to the mounting portions of the terminals; and a hard disk drive casing defining a through opening where the electrical connector is disposed;

wherein the insulative housing is equipped with two anchoring member at two opposite ends thereof, each anchoring member having a pair of first latches extending upward and engaging with edges around the through opening of the hard disk drive to prevent the electrical connector from excessive moving downward, and a pair of second latches extending downward and engaging with the first printed circuit board to prevent the electrical connector from excessive moving upward.

9. The electrical connector assembly as claimed in claim 8, wherein a gasket is located between the first printed circuit board and the electrical connector.

10. The electrical connector assembly as claimed in claim 8, wherein a second printed circuit board is mounted to the other side of the electrical connector opposite to the first printed circuit board and mechanically and electrically connected to the mating portions of the terminals.

11. The electrical connector assembly as claimed in claim 10, wherein both the mating portion and the mounting portion of the terminal are electrically and mechanically connected the first and second printed circuit boards in a manner of solder less compression type.

12. An electrical connector assembly comprising:

an electrical connector including an insulative housing defining opposite mating and mounting faces with a plurality of passageways extending and further through both said mating and mounting faces;

a plurality of contact terminals arranged within each of the passageways, each of said terminals including an mating portion extending beyond of the mating face, and a mounting portion extending beyond the mounting face;

a printed circuit board fastened to a mounting side of the connector and mechanically and electrically connected to the mounting portions of the terminals; and a hard disk drive casing defining a through opening between thereof opposite mating and mounting surfaces; wherein the connector is equipped with at least one anchoring member, and the connector is essentially disposed in the through opening of the anchoring member latched to corresponding edges around the through opening so as to prevent the connector and the associated printed circuit board from being dropped away from the hard disk drive casing in a first direction, under a condition that the printed circuit board defines a horizontal dimension larger than those of the both said connector and said through opening so as to prevent the connector with the associated printed circuit board from being excessive moving with regard to the hard disk drive casing through said through opening in a second direction opposite to said first direction; wherein the connector is assembled into the through opening along said second direction.

* * * * *